US009930469B2

(12) United States Patent
De Poortere

(10) Patent No.: US 9,930,469 B2
(45) Date of Patent: Mar. 27, 2018

(54) SYSTEM AND METHOD FOR ENHANCING VIRTUAL AUDIO HEIGHT PERCEPTION

(71) Applicant: Gibson Innovations Belgium N.V., Leuven (BE)

(72) Inventor: Gerrit De Poortere, Leuven (BE)

(73) Assignee: GIBSON INNOVATIONS BELGIUM N.V., Leuven (BE)

( * ) Notice: Subject to any disclaimer, the term of this patent is extended or adjusted under 35 U.S.C. 154(b) by 92 days.

(21) Appl. No.: 14/848,879

(22) Filed: Sep. 9, 2015

(65) Prior Publication Data

US 2017/0070837 A1 Mar. 9, 2017

(51) Int. Cl.
*H04R 5/02* (2006.01)
*H04S 7/00* (2006.01)
(Continued)

(52) U.S. Cl.
CPC ..... *H04S 7/302* (2013.01); *H04R 1/345* (2013.01); *H04R 5/04* (2013.01); *H04S 5/00* (2013.01);
(Continued)

(58) Field of Classification Search
CPC ..... H04R 1/345; H04R 5/04; H04S 2400/11; H04S 2400/13; H04S 2420/03; H04S 2420/05; H04S 5/00; H04S 7/302
(Continued)

(56) References Cited

U.S. PATENT DOCUMENTS 5,222,145 A 6/1993 Draffen
5,809,150 A 9/1998 Eberbach
(Continued)

FOREIGN PATENT DOCUMENTS

WO WO 1985/001176 3/1985
WO WO 2014/035902 3/2014
(Continued)

OTHER PUBLICATIONS

European Search Report cited in related application EP 16186432, dated Jan. 31, 2017, 3 pgs.

*Primary Examiner* — Paul S Kim
*Assistant Examiner* — Friedrich W Fahnert
(74) *Attorney, Agent, or Firm* — Ryan Kromholz & Manion, S.C.

(57) ABSTRACT

An audio processing system for enhancing a user's virtual audio height perception, comprising: a rebalancing module for receiving audio signals from a source, the audio signals including a low layer signal representing sounds for transmission directly towards a user, and a height signal representing sounds for transmission towards the user by reflecting off a predetermined location above the user; the rebalancing module for comparing the height signal and the lower layer signal, and adjusting an amplitude of the height signal based on said comparison; the low layer signal being transmitted to one or more speakers of a first speaker arrangement for transmitting sound represented by the lower layer signal directly towards the user; and the adjusted height signal being transmitted to one or more speakers of a second speaker arrangement for transmitting sound represented by the height signal towards the user by reflecting off the predetermined location above the user.

20 Claims, 7 Drawing Sheets

(51) Int. Cl.
*H04S 5/00* (2006.01)
*H04R 1/34* (2006.01)
*H04R 5/04* (2006.01)

(52) U.S. Cl.
CPC ..... *H04S 2400/11* (2013.01); *H04S 2400/13* (2013.01); *H04S 2420/03* (2013.01); *H04S 2420/05* (2013.01)

(58) Field of Classification Search
USPC ..... 381/18, 98, 300, 303, 307, 310, 61, 63, 381/304, 305
See application file for complete search history.

(56) References Cited

U.S. PATENT DOCUMENTS

| | | | | |
|---|---|---|---|---|
| 5,870,434 | A | 2/1999 | Greenberger | |
| 8,638,959 | B1 | 1/2014 | Hall | |
| 2003/0031332 | A1 | 2/2003 | Tatsuta et al. | |
| 2006/0159293 | A1 | 7/2006 | Azima et al. | |
| 2006/0204022 | A1 | 9/2006 | Hooley et al. | |
| 2009/0196440 | A1 | 8/2009 | Suzuki | |
| 2011/0216925 | A1 | 9/2011 | Riggs et al. | |
| 2011/0274278 | A1 | 11/2011 | Kim | |
| 2012/0076306 | A1 | 3/2012 | Aarts | |
| 2012/0263324 | A1 | 10/2012 | Joyce et al. | |
| 2012/0328135 | A1* | 12/2012 | De Bruijn | H04R 1/323 381/300 |
| 2013/0101146 | A1 | 4/2013 | Mosgaard | |
| 2014/0126753 | A1* | 5/2014 | Takumai | H04S 7/305 381/303 |
| 2015/0271620 | A1* | 9/2015 | Lando | H04S 5/005 381/18 |
| 2015/0304791 | A1* | 10/2015 | Crockett | H04R 1/26 381/307 |
| 2015/0373454 | A1 | 12/2015 | Shidoji | |
| 2016/0330562 | A1* | 11/2016 | Crockett | H04S 7/301 |

FOREIGN PATENT DOCUMENTS

| | | |
|---|---|---|
| WO | WO 2014/036085 | 3/2014 |
| WO | WO 2014/036121 | 3/2014 |
| WO | WO2014119526 | 8/2014 |

* cited by examiner

SYSTEM AND METHOD FOR ENHANCING VIRTUAL AUDIO HEIGHT PERCEPTION

FIELD

The present invention relates to an audio processing system, and in particular, a system for enhancing a user's virtual audio height perception.

BACKGROUND

A surround sound system typically has a plurality of speaker units arranged around an audience. In a simple surround sound system, such as those used for home entertainment, the speakers may be arranged in a 5.1 speaker configuration consisting of a front left speaker unit, front right speaker unit, rear left speaker unit, rear right speaker unit, a centre speaker unit and a subwoofer. Each speaker unit may include one or more drivers. A driver refers to a single electroacoustic transducer for producing sound in response to an electrical audio input signal from an audio source. The audio source (e.g. a CD, DVD, Blu-ray or digital media content player) may provide different audio signals for different audio channels, where the audio signal for each channel is transmitted to a different speaker unit for generating sound represented by the signal.

In more sophisticated surround sound systems, such as those used in cinemas, there will typically be a larger number of speaker units surrounding the audience. The audio source may provide audio signals for a greater number of audio channels, where the audio signal for each channel may be transmitted to a set of one or more adjacent speaker units located in a particular region relative to the audience for generating sound represented by the signal. By having more speakers generating sound based on the audio signal for different audio channels, the audience is better able to perceive sounds originating from different locations around the audience, thus providing the audience with a more realistic and immersive entertainment experience.

To further enhance the audience's entertainment experience, some surround sound systems include one or more speaker units positioned above the audience for reproducing sound based on audio signals for a height channel. For example, the audio signals for a height channel may represent sounds from objects located above the audience's current perspective in a particular scene, such as the sound of a helicopter flying above the audience. However, there are problems with this approach. Surround sound systems that require one or more speakers on the roof are complicated to setup. For example, it may be complicated or impractical to install one or more speaker units and wiring on the roof of a room or structure, especially in home entertainment environments where there may be a lower ceiling height. After the speaker units are installed, it can be difficult to move the speakers to a different location (e.g. to a different room, or to a new position in the same room to suit a different setup configuration).

Solutions have been proposed to help avoid the use of roof-mounted speakers in a home entertainment environment. In one example, as shown in FIG. 1, upward firing speakers 100 and forward firing speakers 102 are placed adjacent to a television display 104. The speakers 100 and 102 may be separate speaker units (e.g. the upward firing speakers 100 may form part of a sound bar, and the forward firing speakers 102 may form part of floor sitting speaker units), or alternatively, the speakers 100 and 102 may be integrated together as a single speaker unit. The upward firing speakers 102 generate sound based on audio signals from a height channel, and directs the sound to travel along path 106 (i.e. towards a predetermined location 108 (e.g. a part of the roof) located above the listener 110, which is then reflected towards the listener 110). The forward firing speakers 100 generate sound 112 based on audio signals from other audio channels, and direct the sound to travel along path 112 directly towards the listener 110. A problem with this approach is that the height channel typically covers a wide spectrum of audible frequencies, and some of these frequencies (particularly the lower frequencies) lack directivity. This means only some of the sounds (of certain frequencies) will be directed towards the listener 110 after reflection off location 108, while sounds of other frequencies may not be properly directed towards the listener 100 and thus the listener 100 will perceive such sounds to be fainter than sounds properly directed towards the listener 100. Accordingly, the listener 110 will have difficulty hearing some of the sounds originating from the upward firing speakers 100, which may be drowned out by direct sounds originating from the forward firing speakers 102. Consequently, the listener's entertainment experience will be diminished.

An object of the present invention is to provide a system and method to help address one or more of the above identified problems.

SUMMARY OF THE INVENTION

According to a first representative embodiment of the present invention, there is provided an audio processing system for enhancing a user's virtual audio height perception, comprising:

a rebalancing module for receiving audio signals from a source, the audio signals including a low layer signal representing sounds for transmission directly towards a user, and a height signal representing sounds for transmission towards the user by reflecting off a predetermined location above the user;

the rebalancing module for comparing the height signal and low layer signal, and adjusting an amplitude of the height signal based on said comparison;

the low layer signal being transmitted to one or more speakers of a first speaker arrangement for transmitting sound represented by the lower layer signal directly towards the user; and the adjusted height signal being transmitted to one or more speakers of a second speaker arrangement for transmitting sound represented by the height signal towards the user by reflecting off the predetermined location above the user.

Preferably, said adjusting an amplitude of the height signal by the rebalancing module involves increasing an amplitude of the height signal by a gain level based on said comparison.

Preferably, the gain level is one of the following: (i) a predetermined value; or (ii) a value dynamically determined based on the amplitude of low layer signal.

Preferably, the system further comprises of:

a high pass filter for generating a first sound portion of the sounds represented by the adjusted height signal with only frequencies at or above a predetermined frequency threshold, wherein the first sound portion is transmitted to one or more speakers of the second speaker arrangement for transmitting the first sound portion towards the user by reflecting off the predetermined location above the user; and a low pass filter for generating a second sound portion of the sounds represented by the adjusted height signal with only frequencies below the predetermined frequency threshold, wherein the second sound portion is transmitted to one or more speakers of the first and/or second speaker arrangement for transmitting the second sound portion directly towards the user.

Preferably, the predetermined frequency threshold is one of the following: (i) a value of 1 kHz; (ii) a predetermined value between 1 kHz and 1.5 kHz.

Preferably, the system further comprises: a path compensation module for controlling the first and/or second speaker arrangement to generate sound based on the second sound portion and/or the low layer signal after a predetermined first time interval, the first time interval starting from the time at which the first and/or second speaker arrangement generates sound based on a corresponding part of the first sound portion.

Preferably, the first time interval is determined based on a distance between the first and/or second speaker arrangement and the user, and a height between the first and/or second speaker arrangement and the predetermined first region above the user.

Preferably, the first time interval is determined based on sound measurements obtained in an area adjacent to the user.

Preferably, the system further comprises: a precedence effect delay module for controlling the first and/or second speaker arrangement to generate sound based on the second sound portion and/or the low layer signal after a predetermined second time interval, the second time interval starting from the time at which the first and/or second speaker arrangement generates sound based on a corresponding part of the first sound portion.

Preferably, the system further comprises: a precedence effect delay module for controlling the first and/or second speaker arrangement to generate sound based on the second sound portion and/or the low layer signal after a predetermined second time interval, the second time interval starting from the end of the first time interval.

According to a second representative embodiment of the present invention, there is provided an audio processing method for enhancing a user's virtual audio height perception, comprising the steps of:

receiving audio signals from a source, the audio signals including a low layer signal representing sounds for transmission directly towards a user, and a height signal representing sounds for transmission towards the user by reflecting off a predetermined location above the user;

comparing the height signal and the low layer signal, and adjusting an amplitude of the height signal based on said comparison;

transmitting the low layer signal to one or more speakers of a first speaker arrangement for transmitting sound represented by the lower layer signal directly towards the user; and transmitting the adjusted height signal to one or more speakers of a second speaker arrangement for transmitting sound represented by the height signal towards the user by reflecting off the predetermined location above the user.

Preferably, the adjusting step includes: increasing an amplitude of the height signal by a gain level based on said comparison.

Preferably, the gain level is one of the following: (i) a predetermined value; or (ii) a value dynamically determined based on the amplitude of low layer signal.

Preferably, the method further comprises the steps of:

generating a first sound portion of the sounds represented by the adjusted height signal with only frequencies at or above a predetermined frequency threshold, wherein the first sound portion is transmitted to one or more speakers of the second speaker arrangement for transmitting the first sound portion towards the user by reflecting off the predetermined location above the user; and generating a second sound portion of the sounds represented by the adjusted height signal with only frequencies below the predetermined frequency threshold, wherein the second sound portion is transmitted to one or more speakers of the first and/or second speaker arrangement for transmitting the second sound portion directly towards the user.

Preferably, the predetermined frequency threshold is one of the following: (i) a value of 1 kHz; (ii) a predetermined value between 1 kHz and 1.5 kHz.

Preferably, the method further comprises the step of: controlling the first and/or second speaker arrangement to generate sound based on the second sound portion and/or the low layer signal after a predetermined first time interval, the first time interval starting from the time at which the first and/or second speaker arrangement generates sound based on a corresponding part of the first sound portion.

Preferably, the method further comprises the step of: determining the first time interval based on a distance between the first and/or second speaker arrangement and the user, and a height between the first and/or second speaker arrangement and the predetermined first region.

Preferably, the method further comprises the step of: determining the first time interval based on sound measurements obtained in an area adjacent to the user.

Preferably, the method further comprises the step of: controlling the first and/or second speaker arrangement to generate sound based on the second sound portion and/or the low layer signal after a predetermined second time interval, the second time interval starting from the time at which the first and/or second speaker arrangement generates sound based on a corresponding portion of the first sound portion.

Preferably, the method further comprises the step of: controlling the first and/or second speaker arrangement to generate sound based on the second sound portion and/or the low layer signal after a predetermined second time interval, the second time interval starting from the end of the first time interval.

DESCRIPTION OF THE DRAWING FIGURES

Representative embodiments of the present invention are herein described, by way of example only, with reference to the accompanying drawings, wherein.

DETAILED DESCRIPTION

Figure 2A:
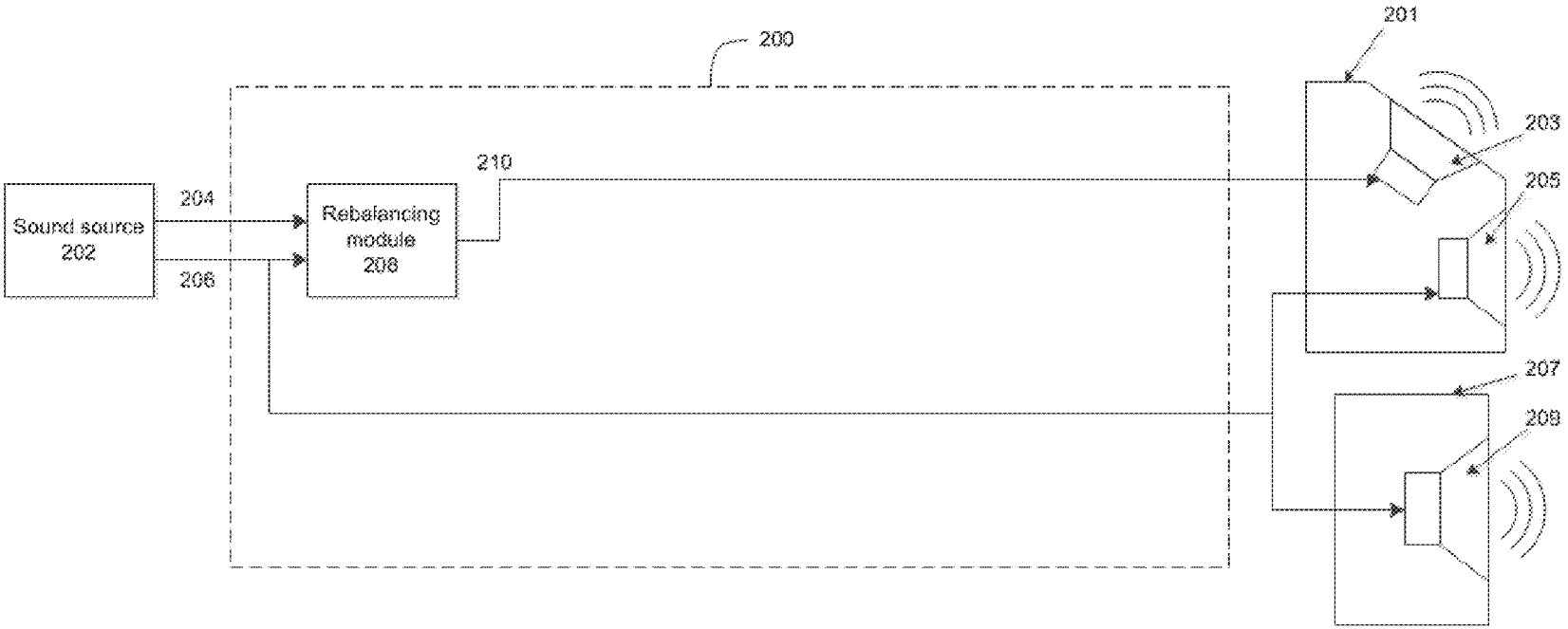
FIG. 2A is a block diagram of the modules in an audio processing system according to a first representative embodiment of the present invention.

FIG. 2A is a block diagram showing the main modules of the audio processing system according to a representative embodiment of the present invention. As shown in FIG. 2, the audio processing system 200 receives electrical audio input signals (i.e. a height signal 204 and low layer signal 206) from an audio source 202 (or sound source), which are processed by the audio processing system 200 to generate electrical audio output signals that are provided to one or more speaker units 201 and 207.

The speaker units 201 and 207 may each comprise of one or more drivers (e.g. 203, 205, 209). A driver refers to a single electroacoustic transducer for producing sound in response to an electrical audio input signal, and for example, can be a flat panel speaker, conventional speaker, a highly directive speaker or the like. In a representative embodiment, the speaker unit 201 may comprise of one or more upward firing speakers 203 and/or one or more forward firing speakers 205. The speakers 203 and 205 may be arranged along or about a longitudinal axis to form a sound bar. In a representative embodiment, the speaker unit 207 may comprise of one or more forward firing speakers 209.

According to a representative embodiment of the present invention, the audio source 202 represents a source of audio signals representing sound to be generated using speaker units 201, 207 connected to the audio processing system 200. For example, the audio source 202 may be a media player device (e.g. a mobile phone, MP3 player, CD player, DVD player, Blu-ray player or digital media content player) that is connected to the audio processing system 200 via a wired or wireless data connection (e.g. via a RCA, USB, optical input, coaxial input, Bluetooth or IEEE 802.11 wireless/WiFi connection). The media player device reads data from storage media (e.g. data stored tape, an optical or magnetic disc, RAM/ROM/flash memory, hard disk, or a network storage device) associated with one or more different audio channels of a piece of media content (e.g. a height channel, front left channel, front right channel, rear left channel, rear right channel, centre channel and subwoofer channel of a music or video recording), and generates a different audio input signal representing the sound to be reproduced for each audio channel. The height channel includes audio data and/or audio signals representing sounds of objects originating from above the audience's current perspective. The lower layer channel includes audio data and/or audio signals representing sounds from one or more other audio channels besides the height channel. In the example shown in FIG. 2A, the audio source 202 generates at least: (i) a height signal 204 representing sounds determined based on data from a height channel, and (ii) a low layer signal 206 representing sounds determined based on data from a lower layer channel.

According to another representative embodiment of the present invention (not shown in the drawings), the audio source 202 can be an audio processing module that forms part of the audio processing system 200. In such an embodiment, the audio source 202 receives audio input signals for one or more audio channels that do not include a height channel, and then based on the audio input signals received, generate at least: (i) a height signal 204 representing sounds for a simulated height channel; and (ii) a low layer signal 206 representing sounds for one or more of the other audio channels. For example, the audio source 202 may determine certain sound components from any of the audio channels to be part of the simulated height channel (and therefore represented by the height signal 204) based on one or more of the following factors: (i) sound components with a pitch above a predetermined frequency value; (ii) sound components predicted to be sounds originating from above audience based on any metadata associated with an audio channel, and/or from a comparison of one or more audio characteristics of corresponding sound components from different audio channels, such as the relative volume, pitch, consistency and/or duration of the sound component over a time interval; (iii) sound components predicted to relate to certain objects (e.g. helicopter blades) based on a comparison of the sound component with a library of sound samples.

In the embodiment shown in FIG. 2A, the audio processing system 200 consists of a rebalancing module 208 that receives the height signal 204 and low layer signal 206 from the audio source 202. The low layer signal 206 generally represents sounds for transmission directly towards the listener (or user). The height signal 206 generally represents sounds intended for transmission to the user from, or by reflecting off, a predetermined location above the user. The rebalancing module 208 compares one or more audio characteristics of the height signal 204 and low layer signal 206, and based on that comparison, adjusts an amplitude level of the height signal 204. For example, the rebalancing module 208 may compare the amplitudes of the height signal 204 and low layer signal 206, and then adjust an amplitude of the height signal 204 based on that comparison.

In a representative embodiment, if the amplitude of the height signal 204 at a particular point in time falls below a predetermined amplitude threshold that is set relative to the amplitude of the low layer signal 206 (e.g. if the amplitude of the height signal 204 is less than the amplitude of the low layer signal 206), then the rebalancing module 208 adjusts the amplitude of the height signal 204 at that particular point in time by a gain level. The gain level can be a predetermined value that increases the current amplitude of the height signal 204 by a predetermined amount. Alternatively, the gain level can be a dynamic value that, for example, increases the current amplitude of the height signal 204 by a predetermined amount over the amplitude of the low layer signal 206 at the corresponding point in time, or by a multiple of the amplitude of the low layer signal 206 at the corresponding point in time. The rebalancing module 208 generates an adjusted height signal 210 that can then be passed to one or more upward firing speakers 203 of speaker unit 201 for transmitting sound towards the user by reflecting off a predetermined location above the user (e.g. 108). The low layer signal 206 can be passed to one or more forward firing speakers 205 or 209 in speaker units 201 and 207 respectively for transmitting sound directly towards the user.

Figure 2B:
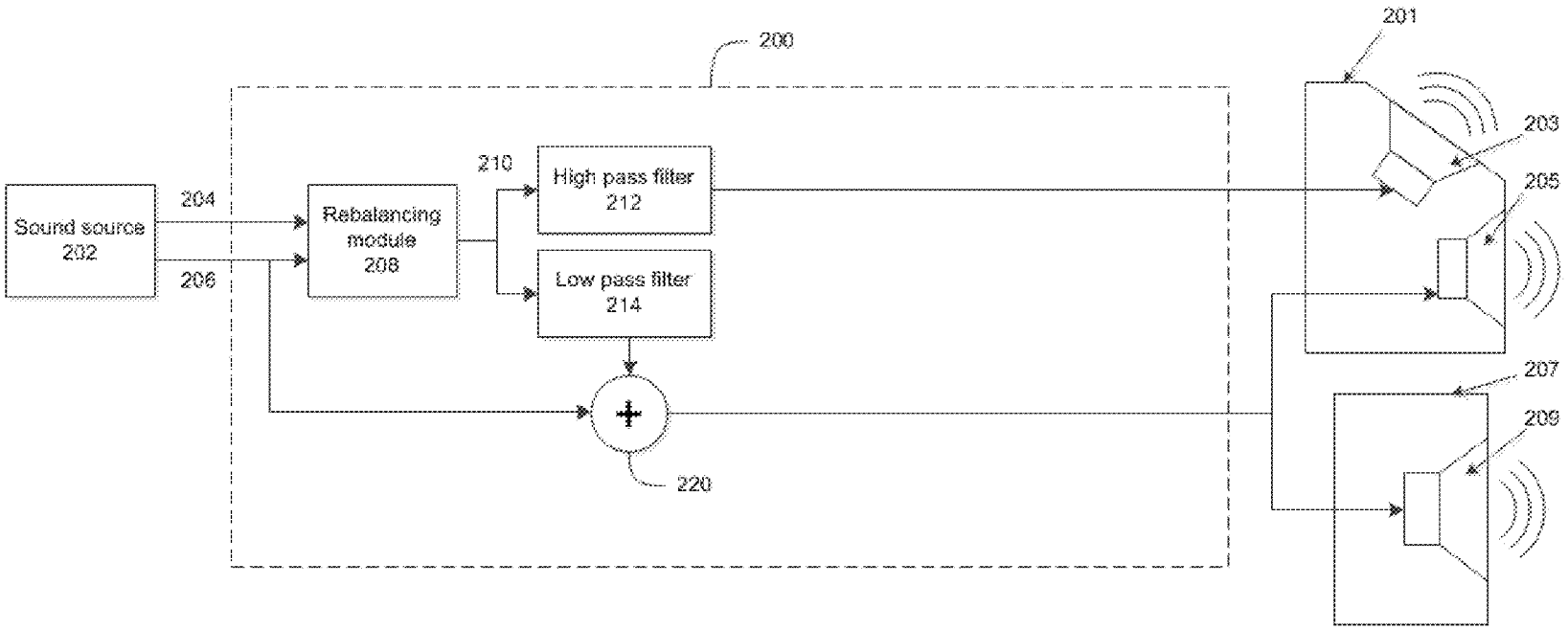
FIG. 2B is a block diagram of the modules in an audio processing system according to a second representative embodiment of the present invention.

The representative embodiment shown in FIG. 2B contains all the features of the embodiment shown in FIG. 2A, but further includes a high pass filter 212, low pass filter 214 and signal combiner 220. In FIGS. 2A and 2B, the same numbers are used to refer to components that are common to both embodiments.

In the representative embodiment shown in FIG. 2B, the adjusted height signal 210 is passed to a high pass filter 212 and a low pass filter 214. The high pass filter 212 generates a first sound portion of the sounds represented by the adjusted height signal 210 with only frequencies at or above a predetermined frequency threshold. The output of the high pass filter 212 may then be passed to one or more upward firing speakers 203 of the speaker unit 201 for transmitting sound towards the user by reflecting off a predetermined location above the user (e.g. 108). In a representative embodiment, the predetermined frequency threshold is 1 kHz, or alternatively, can be a value between 1 kHz and 1.5 kHz. The low pass filter 214 generates a second sound portion of the sounds represented by the adjusted height signal 210 with only frequencies below the predetermined frequency threshold. The output of the low pass filter 214 (either directly or after the signal combiner 220 combines the output of the high pass filter 212 with the low layer signal 206) can be passed to one or more forward firing speakers 205 and/or 209 in speaker units 201 and/or 207 respectively for transmitting sound directly towards the user.

An advantage from using high and low pass filters 212 and 214 is that higher frequency sound components from the adjusted height signal 210, which tend to be more directive, will be directed by the upward firing speakers 203 towards the user by reflection from a point above the user. Since the sound is more directive, the user can hear the sound more clearly even though the sound is reflected. The lower frequency sound components of the adjusted height signal 210, which tend to be less directive, will be directed towards the user directly via the forward firing speakers 205 and/or 209.

Figure 2C:
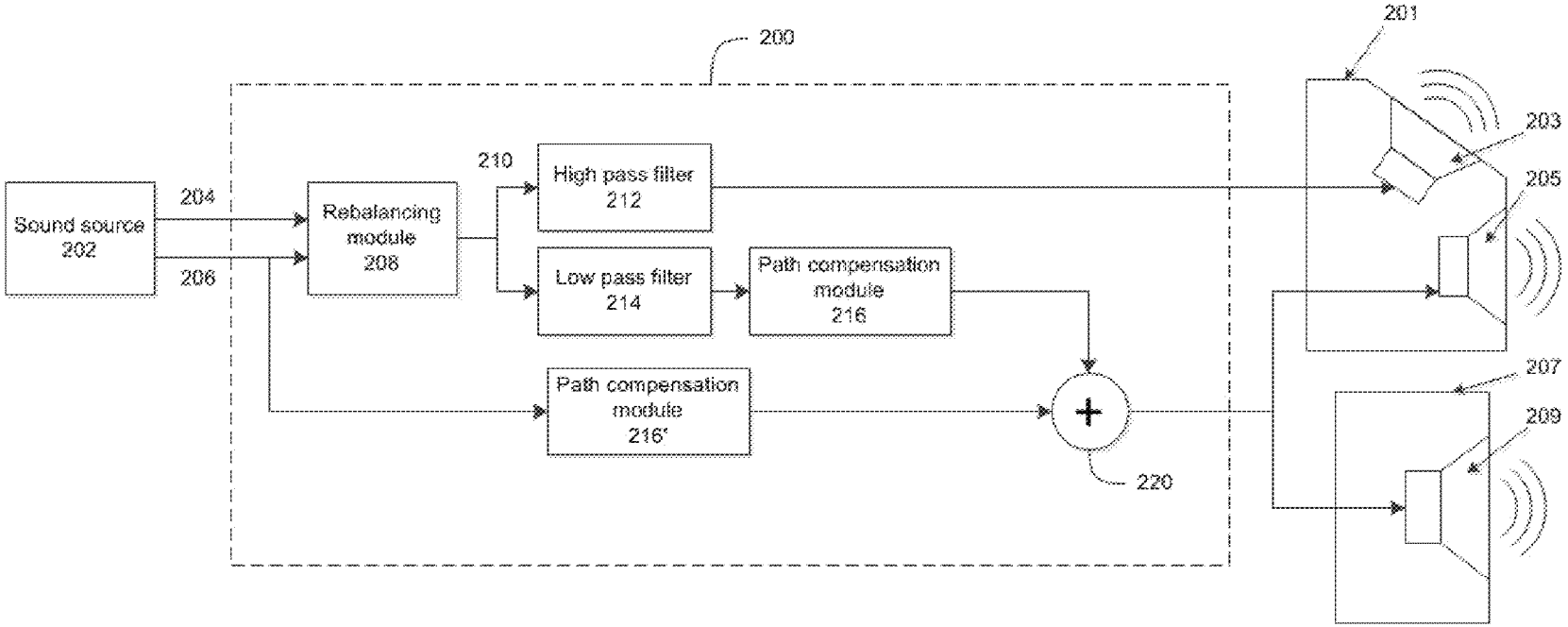
FIG. 2C is a block diagram of the modules in an audio processing system according to a third representative embodiment of the present invention.

The representative embodiment shown in FIG. 2C contains all the features of the embodiment shown in FIG. 2B, but further includes path compensation modules 216 and 216'. The path compensation modules 216 and 216' may be implemented as separate modules, or alternatively, can be provided by way of a single module. In FIGS. 2B and 2C, the same numbers are used to refer to components that are common to both embodiments.

In the representative embodiment shown in FIG. 2C, the second signal portion generated by the low pass filter 214 is passed to a path compensation module 216, and the low layer signal 206 received from the audio source 202 is passed to a path compensation module 216'. Both path compensation modules 216 and 216' introduce a first time delay (represented by a first time interval) to the time at which the second sound portion and preferably also the low layer signal is generated by the speaker units 201 and/or 207. In other words, the path compensation modules 216 and 216' control one or more forward firing speakers 205 and/or 209 in speaker units 201 and/or 207 to generate sound for transmission to the user based on the second sound portion and/or the low layer signal after a predetermined first time interval. The first time interval may start from the time at which the one or more forward firing speakers 205 and/or 209 in speaker units 201 and/or 207 generate sound based on a corresponding part of the first sound portion. In this context, the corresponding part of the first sound portion refers to that part of the audio signal represented by the first sound portion that is received from the audio source 202 at the same time as the relevant part of the second sound portion (and/or low layer signal) being processed by the path compensation module 216 and 216'. The signal combiner 220 may combine the output of the path compensation modules 216 and 216' before the combined signal is passed to one or more forward firing speakers 205 and/or 209 in speaker units 201 and/or 207 for generating sound.

Figure 1:
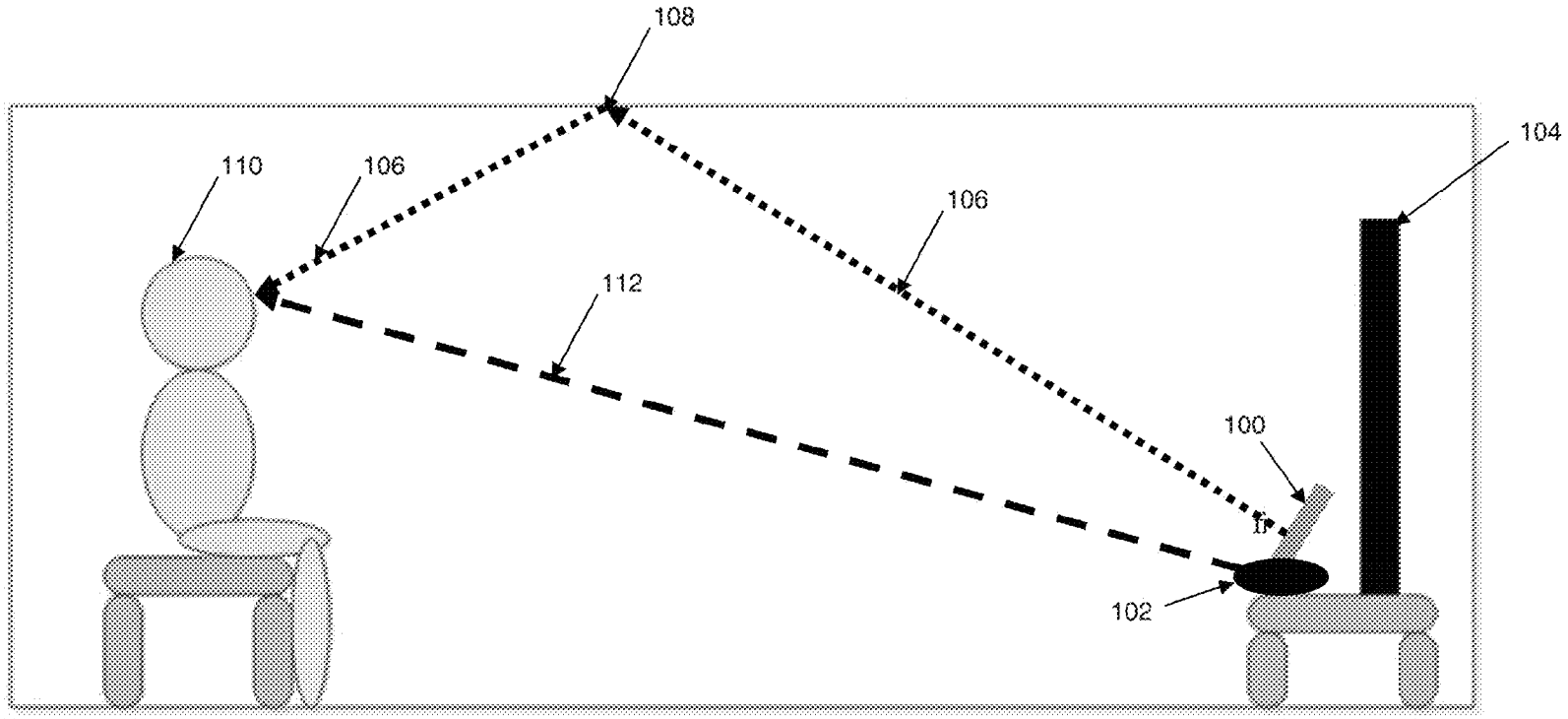
FIG. 1 is a diagram of a prior art sound system.

With reference to FIG. 1, it can be seen that the path of the reflected sound 106 is slightly longer than the path of the direct sound 112, resulting in the reflected sound 106 taking slightly longer in time to reach the listener 110 than the direct sound 112. An advantage of introducing the first time delay is to delay the generation of the direct sounds (e.g. the sound represented by the second sound portion generated by the low pass filter 214 and/or the low layer signal 206) so that these will reach the listener at substantially the same time as the reflected sounds (e.g. the sound represented by the first sound portion generated by the high pass filter 212).

In a representative embodiment, the first time delay is determined based on a distance between the speaker units 201 and/or 207 and the user, and a height between the speaker units 201 and/or 207 and the predetermined first region for reflecting sound above the user (e.g. 108).

Alternatively, in another representative embodiment, the first time delay is determined based on measurements of sound obtained using one or more microphones placed in an area adjacent to the user or listener. The purpose of the sound measurements is to determine the extent of any delay between the arrival of the direct sounds (e.g. the sound represented by the second sound portion generated by the low pass filter 214 and preferably also the low layer signal 206) and the reflected sounds (e.g. the sound represented by the first sound portion generated by the high pass filter 212) to the location of the user. For example, such measurements may be achieved by transmitting a first test signal as reflected sound and then measuring a first time interval at which using the microphones adjacent to the user detected the first test signal. A second test signal may then be transmitted as direct sound and then measuring a second time interval at which the microphones adjacent to the user detected the second test signal. The first time delay may be determined based on the difference between the first time interval and second time interval.

Figure 2D:
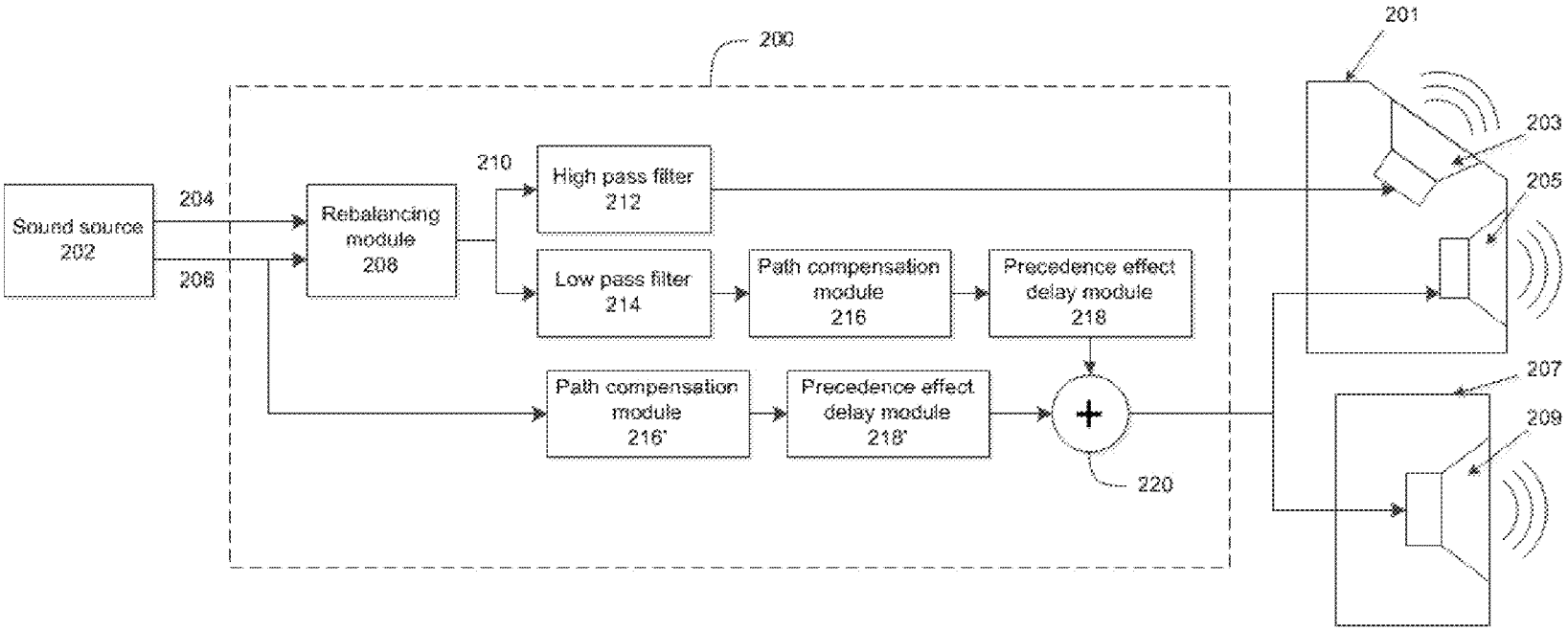
FIG. 2D is a block diagram of the modules in an audio processing system according to a fourth representative embodiment of the present invention.

The representative embodiment shown in FIG. 2D contains all the features of the embodiment shown in FIG. 2C, but further includes precedence effect delay modules 218 and 218'. The precedence effect delay modules 216 and 216' may be implemented as separate modules, or alternatively, can be provided by way of a single module. In FIGS. 2C and 2D, the same numbers are used to refer to components that are common to both embodiments.

In the representative embodiment shown in FIG. 2D, the output of path compensation modules 216 and 216' are respectively passed to precedence effect delay modules 218 and 218'. Both precedence effect delay modules 218 and 218' introduce a second time delay (represented by a second time interval) to the time at which the second sound portion and/or the low layer signal is generated by the speaker units 201 and/or 207. In other words, the precedence effect delay modules 218 and 218' control one or more forward firing speakers 205 and/or 209 in speaker units 201 and/or 207 to generate sound for transmission to the user based on the second sound portion and/or the low layer signal after a predetermined second time interval. For embodiments where the audio processing system 200 has path compensation modules 216 and 216' and precedence effect delay modules 218 and 218', the second time interval may start from the end of the first time interval. For embodiments where the audio processing system 200 has precedence effect delay modules 218 and 218' but no path compensation modules 216 and 216', the second time interval may start from the time at which the one or more forward firing speakers 205 and/or 209 in speaker units 201 and/or 207 generate sound based on a corresponding part of the first sound portion. The value of the second time interval may be a preset value (e.g. preferably 20 milliseconds) determined based on the Haas effect.

An advantage of introducing the second time delay is to delay the generation of the direct sounds (e.g. the sound represented by the second sound portion generated by the low pass filter 214 and preferably also the low layer signal 206) even further so that reflected sounds (e.g. the sound represented by the first sound portion generated by the high pass filter 212) are heard by the user before the direct sounds, thus further enhancing the audible effect of the reflected sounds.

In a representative embodiment, the second time delay is a predetermined time interval. Alternatively, in another representative embodiment, the second time delay can be one of several predetermined time intervals that adopted by the precedence effect delay module 218 based on selection input received from the user.

The representative embodiments of the present invention are based on the principle that up-firing sound devices (e.g. one or more upward firing speakers 203 of speaker unit 201) send sound to the ceiling from where the sound is reflected towards the listener or user. In this way, the listener perceives sound from the up-firing sound device as an elevated sound (i.e. sound originating from an elevated position relative to the listener). In a representative embodiment, the up-firing sound device may have a certain directivity (D(f)). This means that a part of the sound energy is sent towards the ceiling from where it reaches the listener as an elevated sound, and a part of the sound energy is sent in other directions which is perceived by the user as rather direct sound. The direct sound 'blurs' the reflected sound energy, and accordingly, the perception of elevated sound. Also, in a representative embodiment, the directivity is frequency dependent (i.e. the directivity is higher for higher frequencies). With well thought mechanical constructions, it is possible to obtain a certain directivity for lower frequencies (e.g. less than 1 kHz), which can provides users with some perception of elevation for sounds as such lower frequencies, but this may not be as clear as the perception of elevation for higher frequencies.

With increasing or higher frequencies more energy is directed to and reflected from the ceiling ($E_r(f)$), and with decreasing or lower frequencies more energy is directed towards the listener ($E_d(f)$). This can be represented by two intersecting curves. At frequencies which have reflected energy higher than the direct energy (i.e. $E_r>E_d$), the user's perception of height will be present. This can be reformulated so that when the directivity (D) is higher than a critical directivity ($D_{crit}$)—i.e. $D>D_{crit}$—then the user will perceive the sound as being clearly elevated (i.e. originating from an elevated position relative to the user). At frequencies which have direct energy higher than the reflected energy, the direct sound may mask the reflected sound and decrease or destroy the height perception. This can be reformulated so that when the directivity is lower than a critical directivity—i.e. $D\leq D_{crit}$—then the user will perceive the sound less or not at all as being elevated (i.e. not originating from an elevated position relative to the user).

Figure 2E:
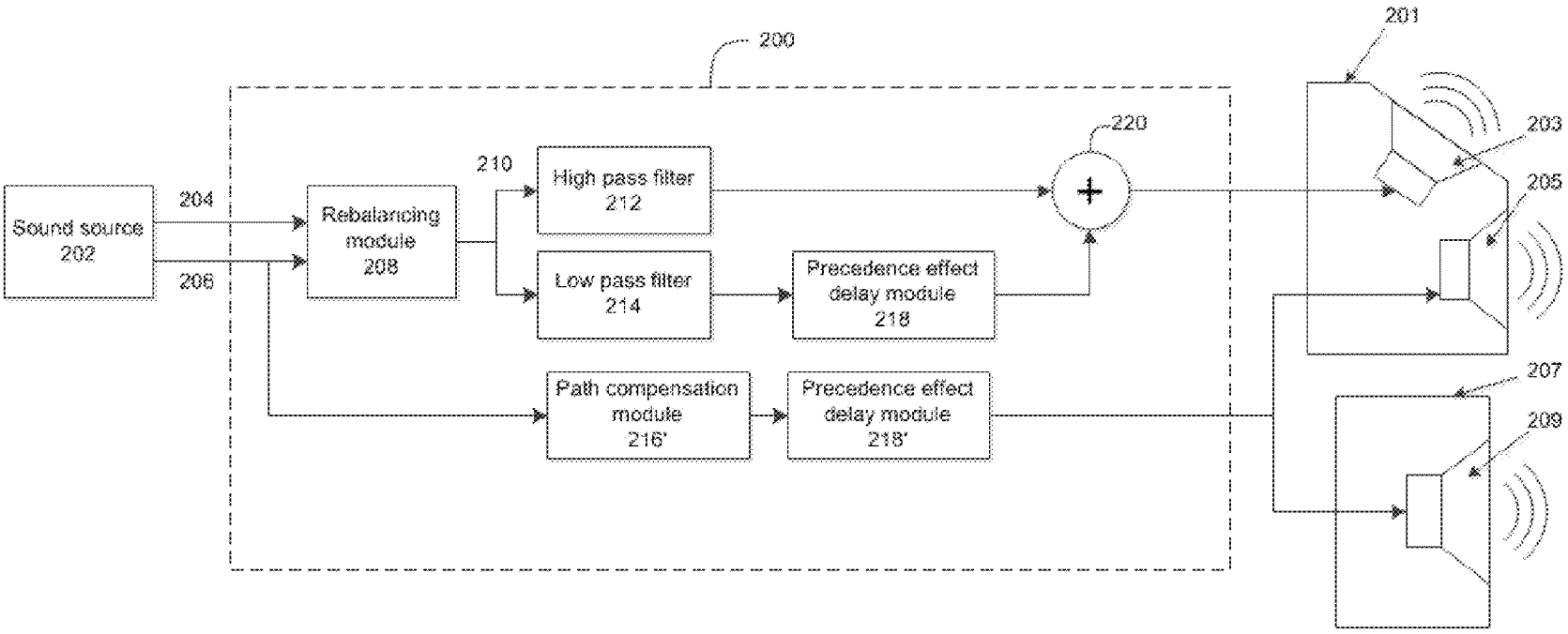
FIG. 2E is a block diagram of the modules in an audio processing system according to a fifth representative embodiment of the present invention.

The representative embodiment shown in FIG. 2E aims to address this problem by introducing a precedence effect in the frequency range that suffers from the reduced height perception. The embodiment take into account two key parameters: (i) the minimum directivity required for the user to obvious or clearly perceive elevated sound from the sound reflected from the ceiling ($D_{crit}$); and (ii) the frequency corresponding to $D_{crit}$ which can be referred to as the critical frequency ($f_{crit}$). The representative embodiment shown in FIG. 2E contains all of the features of the embodiment shown in FIG. 2D, where the same numbers are used to refer to components that are common to both embodiments. To increase the perception of $D_{crit}$ at frequencies less than $f_{crit}$, the following is done. The total frequency band of the output from the rebalancing module 208 is passed to the high pass filter 212 and low pass filter 213. The high pass filter 212 generates a first sound portion of the sounds represented by the adjusted height signal 210 with only frequencies at or above $f_{crit}$. The low pass filter 214 generates a second sound portion of the sounds represented by the adjusted height signal 210 with only frequencies below $f_{crit}$. The output of the low pass filter 214 is processed by a precedence effect delay module 218 (which performs the same function as module 218 in FIG. 2D). In FIG. 2E, the output of the precedence effect delay module 218 and the output of the high pass filter 212 are combined together using a signal combiner 220, after which the combined signal is passed to one or more upward firing speakers 203 of speaker unit 201. The output of precedence effect delay module 218' can be passed to one or more forward firing speakers 205 and/or 209 in speaker units 201 and/or 207 respectively for transmitting sound directly towards the user. In the representative embodiment shown in FIG. 2E, the precedence effect delay module 218 can help improve the listener's psycho-acoustical perception of sounds with frequencies below $f_{crit}$ as originating from the ceiling or at least with increase elevation.

Figure 3:
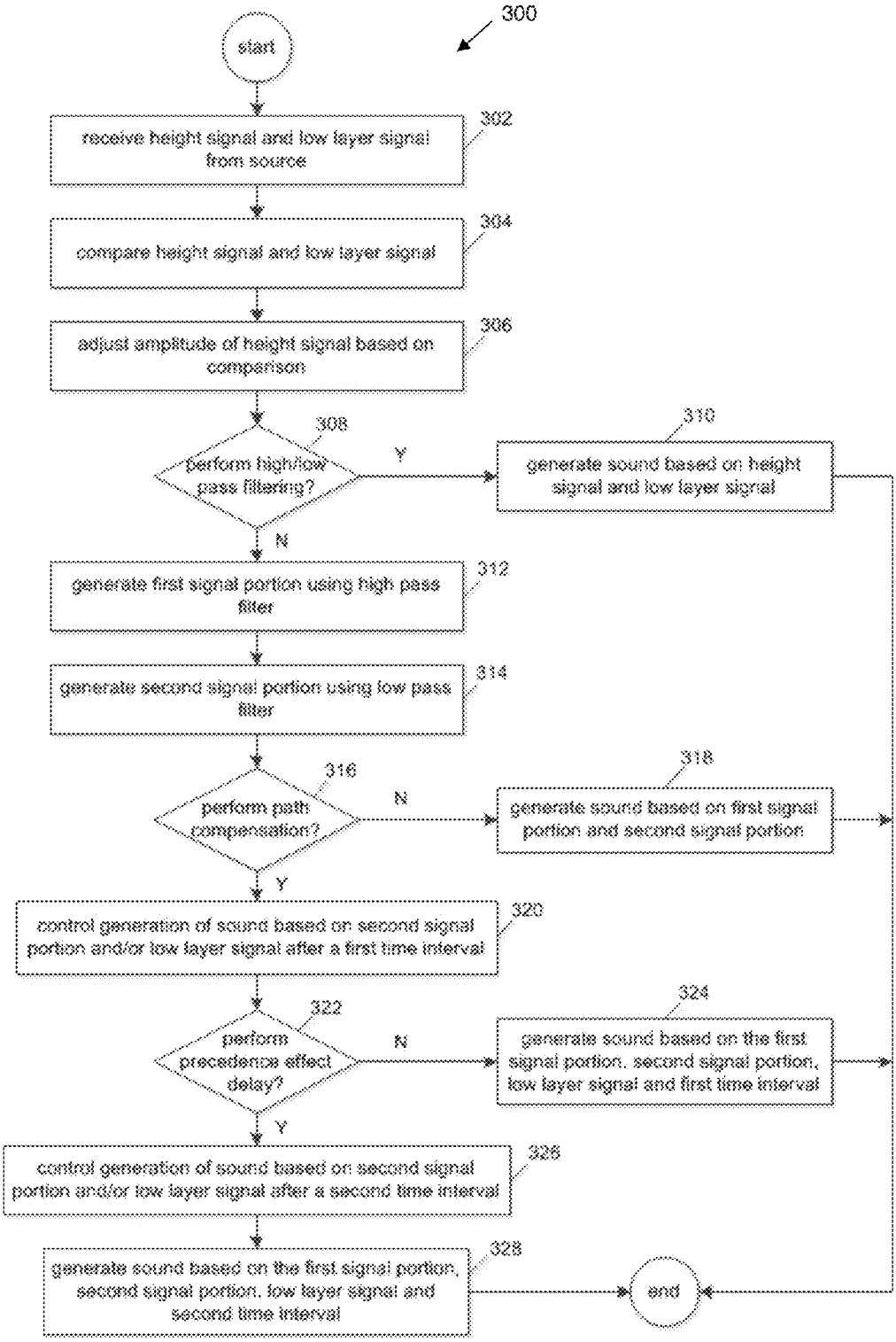
FIG. 3 is a flow diagram of an audio processing method according to a representative embodiment of the present invention.

FIG. 3 is a flowchart of the processing steps in an audio processing method 300 performed by the modules of the audio processing system 200 as described in any one of FIG. 2A, 2B, 2C or 2D. A person skilled in the art will appreciate that any of the features (in whole or in part) provided by any one or more of the modules as described with reference to FIG. 2A, 2B, 2C or 2D, and any one or more of the steps (in whole or in part) as described with reference to FIG. 3, can be implemented using hardware (e.g. by one or more discrete circuits, Application Specific Integrated Circuits (ASICs), and/or Field Programmable Gate Arrays (FPGAs)), or using software (e.g. the relevant features are performed by a digital processor module operating under the control of code, signals and/or instructions accessed from memory), or using a combination of hardware and software as described above.

The audio processing method 300 begins at step 302, where the audio processing system 200 receives a height signal 204 and low layer signal 206 from the audio source 202. At step 304, the rebalancing module 208 compares one or more audio characteristics (e.g. amplitude) of the height signal 204 and the low layer signal 206. At step 306, the rebalancing module 208 adjusts an amplitude of the height signal 204 based on the comparison performed at step 304.

Step 308 determines whether it is necessary to further process the output of the rebalancing module 208 using a high pass filter 212 and low pass filter 214. If step 308 determines there is no such need (e.g. based on data representing user or system preferences, or the absence of a high pass filter 212 and low pass filter 214 in the audio processing system 200), then at step 310, the output 210 of the rebalancing module 208 is passed to one or more upward firing speakers 203 of speaker unit 201 for generating sound directed to the user by reflection off a predetermined location above the user, and the low layer signal 206 is passed to one or more forward firing speakers 205 and/or 209 in speaker units 201 and/or 207 for generating sound directed towards the user.

If step 308 determines there is such need (e.g. based on data representing user or system preferences, or the presence of a high pass filter 212 and low pass filter 214 in the audio processing system 200) the output of the rebalancing module 208 is passed to both the high pass filter 212 and low pass filter 214. At step 312, the high pass filter 212 generates a first signal portion based on the adjusted height signal 210 output of the rebalancing module 208. As described above, the first signal portion contains sounds with frequencies at or above a predetermined frequency threshold. At step 314, the low pass filter 214 generates a second signal portion based on the adjusted height signal 210 output of the rebalancing module 208. As described above, the second signal portion contains sounds with frequencies below a predetermined frequency threshold.

Step 316 determines whether it is necessary to further process the output of the high pass filter 212 and low pass filter 214 by path compensation modules 216 and 216'. If step 316 determines there is no such need (e.g. based on data representing user or system preferences, or the absence of path compensation modules 216 and 216' in the audio processing system 200), then at step 318, the output generated by the high pass filter 212 is passed to one or more upward firing speakers 203 of speaker unit 201 for generating sound directed to the user by reflection off a predetermined location above the user, and the output generated by the low pass filter 214 is passed to one or more forward firing speakers 205 and/or 209 in speaker units 201 and/or 207 for generating sound directed towards the user.

If step 316 determines there is such need (e.g. based on data representing user or system preferences, or the presence of path compensation modules 216 and 216' in the audio processing system 200) the output generated by the low pass filter 214 is passed to the path compensation module 216, and the low layer signal 206 received from the audio source 206 may be passed to the path compensation 216'. At step 320, the path compensation modules 216 and 216' control the generation of sound based on the second signal portion and/or the low layer signal after a first time interval. The details of this step involves has already been described with reference to FIG. 2C.

Step 322 determines whether it is necessary to further process the output of the rebalancing module 208 using precedence effect delay modules 218 and 218'. If step 308 determines there is no such need (e.g. based on data representing user or system preferences, or the absence of precedence effect delay modules 218 and 218' in the audio processing system 200), then at step 324, the output generated by the high pass filter 212 is passed to one or more upward firing speakers 203 of speaker unit 201 for generating sound directed to the user by reflection off a predetermined location above the user, and the output generated by the path compensation modules 216 and 216' are combined (e.g. using a combiner module 220 or similar means) and passed to one or more forward firing speakers 205 and/or 209 in speaker units 201 and/or 207 for generating sound directed towards the user.

If step 322 determines there is such need (e.g. based on data representing user or system preferences, or the presence of precedence effect delay modules 218 and 218' in the audio processing system 200) the output of the path compensation modules 216 and 216' are passed to precedence effect delay modules 218 and 218' respectively. At step 326, the precedence delay effect modules 218 and 218' control the generation of sound based on the second signal portion and/or the low layer signal after a second time interval. The details of this step involves has already been described with reference to FIG. 2D. For example, in some embodiments, the second time interval may start after the first time interval. In some embodiments, the second time interval may start from the time at which the one or more forward firing speakers 205 and/or 209 in speaker units 201 and/or 207 generate sound based on a corresponding part of the first sound portion.

At step 328, the output generated by the high pass filter 212 is passed to one or more upward firing speakers 203 of speaker unit 201 for generating sound directed to the user by reflection off a predetermined location above the user, and the output generated by the precedence effect delay modules 218 and 218' are combined (e.g. using a combiner module 220 or similar means) and passed to one or more forward firing speakers 205 and/or 209 in speaker units 201 and/or 207 for generating sound directed towards the user.

The audio processing method 300 ends after steps 310, 318, 324 and 328.

In the application, unless specified otherwise, the terms "comprising", "comprise", and grammatical variants thereof, intended to represent "open" or "inclusive" language such that they include recited elements but also permit inclusion of additional, non-explicitly recited elements.

While this invention has been described with reference to exemplary embodiments, it will be understood by those skilled in the art that various changes can be made and equivalents may be substituted for elements thereof, without departing from the spirit and scope of the invention. In addition, modification may be made to adapt the teachings of the invention to particular situations and materials, without departing from the essential scope of the invention. Thus, the invention is not limited to the particular examples that are disclosed in this specification, but encompasses all embodiments falling within the scope of the appended claims.

The invention claimed is:

1. An audio processing system for enhancing a user's virtual audio height perception, comprising:

a rebalancing module for receiving at least two distinct audio signals from a source, the audio signals including a low layer signal representing sounds for transmission directly towards a user, and a separate height signal representing sounds for transmission towards the user by reflecting off a predetermined location above the user;

the rebalancing module for comparing an amplitude of the height signal to a threshold amplitude set relative to an amplitude of the low layer signal, and adjusting said amplitude of the height signal based on said comparison;

the low layer signal being transmitted to one or more speakers of a first speaker arrangement for transmitting sound represented by the low layer signal directly towards the user; and the adjusted height signal being transmitted to one or more speakers of a second speaker arrangement for transmitting sound represented by the height signal towards the user by reflecting off the predetermined location above the user.

2. An audio processing system according to claim 1, wherein said adjusting an amplitude of the height signal by the rebalancing module involves increasing an amplitude of the height signal by a gain level based on said comparison.

3. An audio processing system according to claim 2, wherein the gain level is one of the following (i) a predetermined value; or (ii) a value dynamically determined based on the amplitude of low layer signal.

4. An audio processing system according to claim 1, further comprising:

a high pass filter for generating a first sound portion of the sounds represented by the adjusted height signal with only frequencies at or above a predetermined frequency threshold, wherein the first sound portion is transmitted to one or more speakers of the second speaker arrangement for transmitting the first sound portion towards the user by reflecting off the predetermined location above the user; and a low pass filter for generating a second sound portion of the sounds represented by the adjusted height signal with only frequencies below the predetermined frequency threshold, wherein the second sound portion is transmitted to one or more speakers of the first and/or second speaker arrangement for transmitting the second sound portion directly towards the user.

5. An audio processing system according to claim 4, wherein the predetermined frequency threshold is one of the following: (i) a value of 1 kHz; (ii) a predetermined value between 1 kHz and 1.5 kHz.

6. An audio processing system according to claim 4, further comprising:

a path compensation module for controlling the first and/or second speaker arrangement to generate sound based on the second sound portion and/or the low layer signal after a predetermined first time interval, the first time interval starting from the time at which the first and/or second speaker arrangement generates sound based on a corresponding part of the first sound portion.

7. An audio processing system according to claim 6, wherein the first time interval is determined based on a distance between the first and/or second speaker arrangement and the user, and a height between the first and/or second speaker arrangement and the predetermined first region above the user.

8. An audio processing system according to claim 6, wherein the first time interval is determined based on sound measurements obtained in an area adjacent to the user.

9. An audio processing system according to claim 4, further comprising:

a precedence effect delay module for controlling the first and/or second speaker arrangement to generate sound based on the second sound portion and/or the low layer signal after a predetermined second time interval, the second time interval starting from the time at which the first and/or second speaker arrangement generates sound based on a corresponding part of the first sound portion.

10. An audio processing system according to claim 6, further comprising:

a precedence effect delay module for controlling the first and/or second speaker arrangement to generate sound based on the second sound portion and/or the low layer signal after a predetermined second time interval, the second time interval starting from the end of the first time interval.

11. An audio processing method for enhancing a user's virtual audio height perception, comprising the steps of:

receiving at least two distinct audio signals from a source, the audio signals including a low layer signal representing sounds for transmission directly towards a user, and a separate height signal representing sounds for transmission towards the user by reflecting off a predetermined location above the user;

comparing an amplitude of the height signal to a threshold amplitude set relative to an amplitude of the low layer signal, and adjusting said amplitude of the height signal based on said comparison;

transmitting the low layer signal to one or more speakers of a first speaker arrangement for transmitting sound represented by the low layer signal directly towards the user; and transmitting the adjusted height signal to one or more speakers of a second speaker arrangement for transmitting sound represented by the height signal towards the user by reflecting off the predetermined location above the user.

12. An audio processing method according to claim 11, wherein the adjusting step includes: increasing an amplitude of the height signal by a gain level based on said comparison.

13. An audio processing method according to claim 12, wherein the gain level is one of the following: (i) a predetermined value; or (ii) a value dynamically determined based on the amplitude of low layer signal.

14. An audio processing method according to claim 11, further comprising the steps of:

generating a first sound portion of the sounds represented by the adjusted height signal with only frequencies at or above a predetermined frequency threshold, wherein the first sound portion is transmitted to one or more speakers of the second speaker arrangement for transmitting the first sound portion towards the user by reflecting off the predetermined location above the user; and generating a second sound portion of the sounds represented by the adjusted height signal with only frequencies below the predetermined frequency threshold, wherein the second sound portion is transmitted to one or more speakers of the first and/or second speaker arrangement for transmitting the second sound portion directly towards the user.

15. An audio processing method according to claim 14, wherein the predetermined frequency threshold is one of the following (i) a value of 1 kHz; (ii) a predetermined value between 1 kHz and 1.5 kHz.

16. An audio processing method according to claim 14, further comprising the step of:

controlling the first and/or second speaker arrangement to generate sound based on the second sound portion and/or the low layer signal after a predetermined first time interval, the first time interval starting from the time at which the first and/or second speaker arrangement generates sound based on a corresponding part of the first sound portion.

17. An audio processing method according to claim 16, further comprising the step of:

determining the first time interval based on a distance between the first and/or second speaker arrangement and the user, and a height between the first and/or second speaker arrangement and the predetermined first region.

18. An audio processing method according to claim 16, further comprising the step of:

determining the first time interval based on sound measurements obtained in an area adjacent to the user.

19. An audio processing method according to claim 14, further comprising the step of:

controlling the first and/or second speaker arrangement to generate sound based on the second sound portion and/or the low layer signal after a predetermined second time interval, the second time interval starting from the time at which the first and/or second speaker arrangement generates sound based on a corresponding portion of the first sound portion.

20. An audio processing method according to claim 16, further comprising the step of:

controlling the first and/or second speaker arrangement to generate sound based on the second sound portion and/or the low layer signal after a predetermined second time interval, the second time interval starting from the end of the first time interval.

* * * * *